United States Patent [19]

Vignon

[11] 4,202,162

[45] May 13, 1980

[54] PROCESS AND APPARATUS FOR SPINNING TEXTILE FIBRES

[75] Inventor: Louis Vignon, Geneva, Switzerland

[73] Assignee: Heberlein Hispano SA, Vernier, Switzerland

[21] Appl. No.: 959,190

[22] Filed: Nov. 8, 1978

[30] Foreign Application Priority Data

Nov. 9, 1977 [CH] Switzerland ..... 13652/77
Sep. 4, 1978 [CH] Switzerland ..... 9696/78

[51] Int. Cl.[2] ..... D01H 1/12

[52] U.S. Cl. ..... 57/58.89; 57/58.95; 57/240

[58] Field of Search ..... 57/58.89–58.95, 57/327, 334, 337, 340

[56] References Cited

U.S. PATENT DOCUMENTS 3,635,006 1/1972 Fehrer ..... 57/327 X
3,981,137 9/1976 Fehrer ..... 57/58.89 X
4,051,653 10/1977 Mitteregger ..... 57/58.89
4,060,966 12/1977 Konig ..... 57/58.89
4,130,983 12/1978 Dammann et al. ..... 57/58.89 X

FOREIGN PATENT DOCUMENTS 2501193 8/1975 Fed. Rep. of Germany .

*Primary Examiner*—John Petrakes
*Attorney, Agent, or Firm*—Young & Thompson

[57] ABSTRACT

A process and apparatus for spinning textile fibres in which the separated fibres are conveyed in an air stream into a confined space between two contra rotating friction discs (6,7). The air stream enters through an opening (5) in one disc (6) and passes through a permeable collecting surface (9,13) into a static suction exit passage (15) located within the other disc (7). The fibres are drawn off at right angles through the annular gap between the two discs and in doing so are twisted into a roving (16).

9 Claims, 5 Drawing Figures

PROCESS AND APPARATUS FOR SPINNING TEXTILE FIBRES

Figure 1:
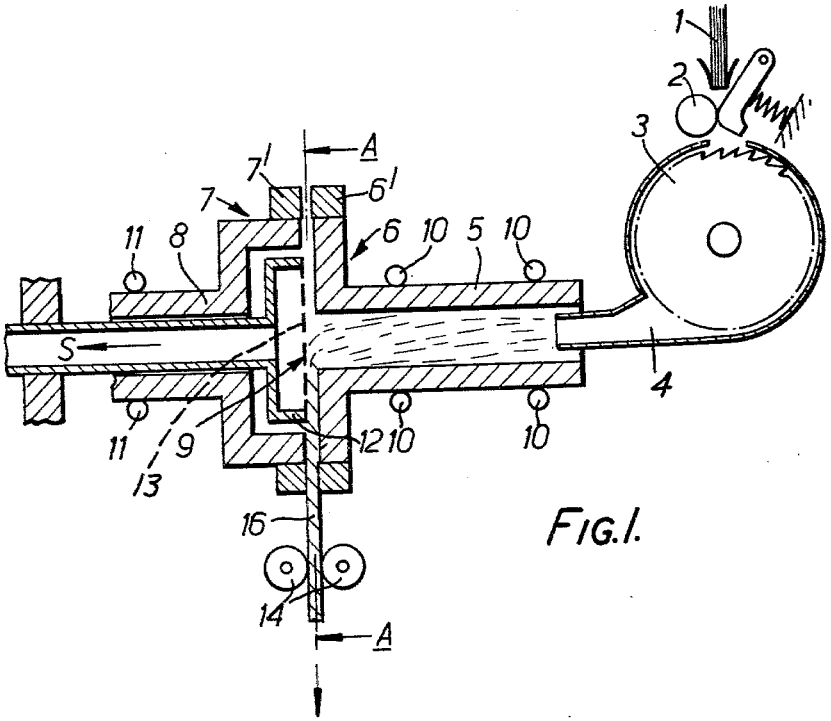

The invention relates to a process and device for spinning textile fibres, in which the fibres are transferred to a gas permeable collecting surface, mechanically twisted and drawn off in yarn form.

In one prior proposal of this type the fibres are transferred to a continuously moving permeable collecting surface allowing the through-flow of air within a defined suction zone in the direction of delivery. Twisting of the fibres results from the force components arising from the surface movement and the suction effect in this boundary area, and the fibres are drawn off at right angles to the surface movement with rotational restraint whereby the twisted fibres receive additional twist between the ends of a pair of circular belts facing one another but moving in opposite directions to one another before reaching the point of rotational arrestment.

This process causes a cylindrically-shaped rotational movement of the fibres in the boundary area of the suction zone simply by the surface movement and the suction effect; it does not therefore call for the use of a special mechanical twisting device. The two circular belts are only used for introducing additional twist into the yarn thus produced.

Another process produces a roving of fibres from a continuously fed stream of fibre material on a permeable collecting surface which allows throughflow of air and precedes the rotational point, the roving being drawn off and twisted so that the length of the suction zone in the direction of delivery corresponds approximately to the fibre length and the width of the suction zone corresponds approximately to the diameter of the roving, only the volume of the air flow being essentially removed in the suction zone. The shell of a rotating suction drum is preferably used as a collecting surface and two pairs of crossed belts can be used as a twisting device with the belt ends facing each other and running in opposite directions.

These processes are primarily suited to spinning relatively long fibres e.g. wool. For spinning relatively short fibres, e.g. cotton, the first mentioned process has a decided disadvantage in that an inadequate degree of twist is achieved and the second process presents enormous difficulties in producing the roving.

Furthermore, it is questionable whether an adequate degree of twist can be achieved merely by using pairs of crossed endless belts since these twisting devices tend to create a substantial amount of slippage.

An object of the present invention is to reduce some of the existing problems and shortcomings and to produce a process for spinning relatively short fibres with high twist and delivery rates.

From one aspect the invention consists in a process for spinning textile fibres, in which the fibres are transferred to a gas permeable collecting surface with a defined suction zone, mechanically twisted and drawn off in yarn form, the fibres being fed to the suction zone in a gas stream inclined to the surfaces of a pair of closely spaced friction discs rotating in opposite directions to one another, the fibres being fed at an angle to the direction of the gas stream into the gap between the discs.

From another aspect the invention consists in apparatus for carrying out the process, comprising a guide duct, a perforated or permeable collecting surface with a suction zone, a twisting device comprising two closely spaced friction discs arranged to be driven in opposite directions and each having a central opening or passage, the collecting surface being fitted in the exit opening through the downstream friction disc.

Figure 2:
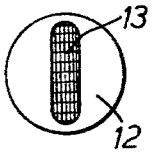
Figure 3:
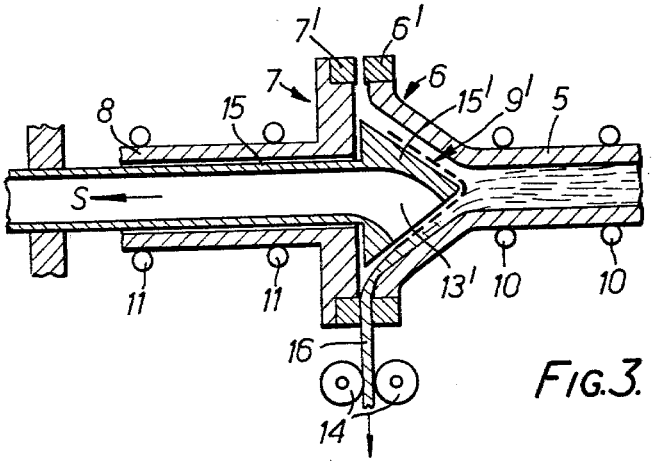
Figure 4:
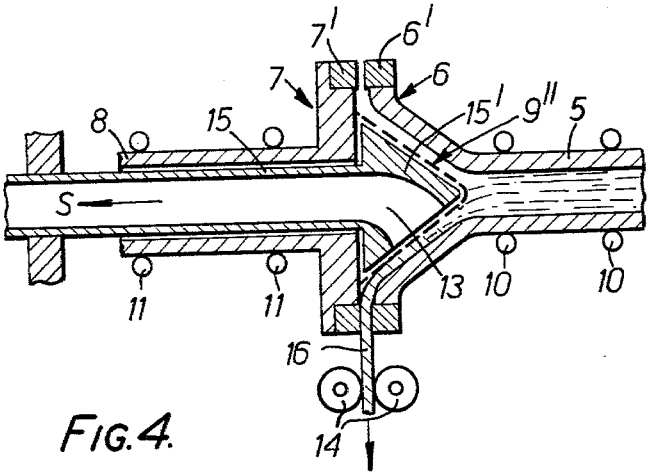
Figure 5:
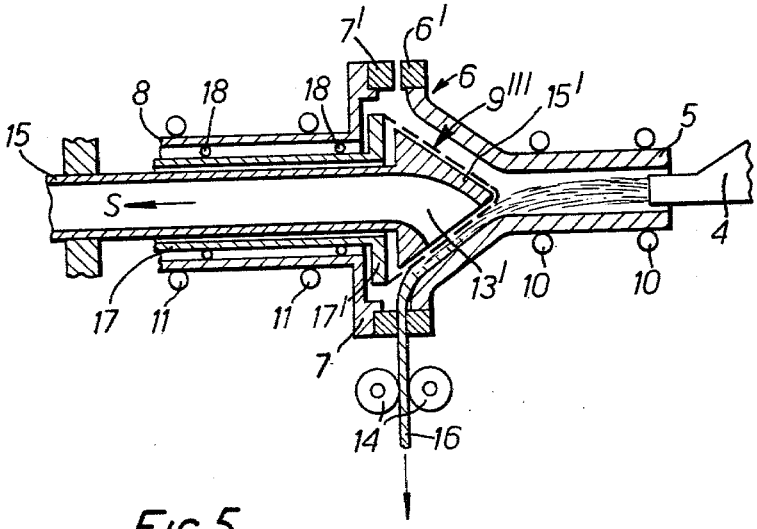

The invention may be performed in various ways and one specific embodiment will now be described by way of example with reference to the accompanying diagrammatic drawings, in which:

FIG. 1 is a longitudinal cross-section through a device for carrying out the invention, FIG. 2 is a detail sectional view on the line A—A of the device of FIG. 1, FIG. 3 is a longitudinal cross-section through a variation of the device according to FIG. 1, FIG. 4 is a longitudinal cross-section through a variation of the device according to FIG. 3, FIG. 5 is a longitudinal cross-section through a further variation of the device according to FIG. 3.

FIG. 1 illustrates the fibre material being fed as a web 1 by a delivery roll 2 onto a toothed drum 3 which separates the web into individual fibres which are ejected and conveyed to a guide duct 4 by the rotation of the drum. The end of the guide duct 4 engages with the end of a hollow shaft 5 at whose opposite end a friction disc 6 is mounted. The friction disc 6 has a central opening corresponding to the internal diameter of the hollow shaft. Opposite the friction disc 6 and narrowly spaced therefrom is a second friction disc 7 mounted at one end of a second hollow shaft 8, the two hollow shafts 5 and 8 being mounted for rotation in bearings 10 and 11. The hollow shaft 8 has a funnel-shaped enlargement at the end holding the friction disc 7 and also has a concentric central opening corresponding to the internal diameter of the enlarged end of the hollow shaft 8. Located within the hollow shaft 8 is a fixed suction member 12 connected to a source of negative pressure (not illustrated), its funnel-shaped end being provided with a perforated collecting surface 9. The chamber within the suction member 12 is elongated to the collecting surface 9, forming a suction zone 13 whose width is approximately 3–4 mm and length approximately equivalent to that of the fibres and approximately equal to the full diameter of the member 12.

The fibres conveyed into the guide duct 4 are transferred to the suction zone 13 from where they are passed at right angles to the direction S of the current of air into the gap between the friction discs 6, 7. This serves to impart twist, after which the yarn 16 thus produced is drawn off by the following pair of rolls 14.

The facing surfaces of the friction discs 6, 7 are preferably not exactly parallel, are less closely spaced on the side adjacent the draw-off rolls so as to assure improved frictional contact between the edges 6', 7' of the discs 6, 7. The discs are preferably made of polyurethane, which has a high coefficient of friction in relation to the fibre material. The accurately pre-determined clearance between the edges 6' and 7' of the discs is maintained by the negative pressure within the device.

It will be seen that the fibres are contained in a totally enclosed system throughout the spinning process, thereby offering a number of advantages in the spinning of relatively short fibres and eliminating the continuous ejection of lint into the working area during operation. Undesired accumulations of fibre material on the collecting surface 9 are further prevented by the width limitations of the suction zone 13.

As can be seen in FIG. 3 representing a variant of the device described above, the hollow shaft 8 contains a fixed suction element 15 with a tapered end and also a tapered collecting surface element 9'. The orifice of the suction element 15 is reduced in size towards the collecting surface 9' and forms the suction zone 13, the length corresponding approximately to the length of the conical shell of the end piece 15', or the fibre length, and the width amounting approximately to 3–4 mm. The use of the tapered collecting surface 9' causes the fibres to change direction continuously from the hollow shaft 5 to the gap between the friction discs 6, 7, thereby assuring constant feed of the fibres to the twist device.

As can be seen in FIG. 4 representing a variant of the device described above, the free ends or edge of the tapered collecting surface 9'', which is supported by the suction element 15, are connected to the friction disc 7, thus ensuring that the collecting surface 9'' describes the same circular movement as the hollow shaft 8 and that the suction zone 13 is not always presented to the same part of the collecting surface.

As can be seen in FIG. 5 representing another variant of the device as depicted in FIG. 3, the hollow shaft 8 contains a coaxial, cylindrical support which is hollow, has a disc-shaped edge at one end, and is pivoted in the ball-bearings 18. The support in turn contains the fixed suction element 15, and the suction zone 13 is connected to a negative pressure source and has a tapered end-piece 15'. Located on the end-piece 15' is a tapered collecting surface 9''', the free ends being connected to the disc-shaped end flange 17' of the support 17.

The support 17 and the collecting surface 9''', which is securely connected to it, can be rapidly rotated regardless of the rotational speed of the friction discs 6, 7, thereby assuring that the suction zone 13 is not always presented to the same part of the collecting surface 9''' and eliminating to a large extent obstruction of the suction zone 13 by fibre material.

I claim:

1. A process for spinning textile fibres, in which the fibres are transported in a gas stream to a gas permeable collecting surface having a defined suction zone located between a pair of substantially parallel closely spaced rotary friction discs, at least part of the gas stream is caused to pass through the said gas permeable collecting surface, the fibres are angularly diverted from the direction of the gas stream flowing through the collecting surface, the fibres being fed into the gap between the discs, the discs are rotated in opposite directions and the fibres are mechanically twisted thereby, and drawn off in yarn form.

2. Apparatus for spinning textile fibres comprising a guide duct, means for feeding fibres in a gas stream through said duct, a gas permeable collecting surface with a suction zone located adjacent the exit from said duct, a twisting device comprising two closely spaced rotary friction discs and means for causing rotation of said discs in opposite directions, each disc having a central opening, the opening in one disc communicating with said guide duct while the opening in the other disc provides a gas exit opening for gas passing through said suction zone, the gap between said discs providing an exit for the fibres which are twisted thereby into the form of a yarn.

3. Apparatus according to claim 2, in which the collecting surface is substantially flat.

4. Apparatus according to claim 3, in which the length of said suction zone measured in the direction in which the fibres are drawn off is approximately equal to the full transverse dimension of the collecting surface, and also to the fibre length, and the width of said suction zone is approximately 3–4 mm.

5. Apparatus according to claim 2, in which each friction disc is located at the end of a hollow shaft, one of which shafts surrounds said guide duct, while the other shaft contains a suction tube supporting the collecting surface and connected to a source of negative pressure.

6. Apparatus according to claim 2, in which the collecting surface is non-planar and has a central part projecting upstream towards the gas flow in said guide duct.

7. Apparatus according to claim 6, in which the length of the suction zone is approximately equal to the full length of the collecting surface, measured from the centre of the projecting part to the periphery of said surface, and to the length of the fibres, and the width of the suction zone is approximately 3–4 mm.

8. Apparatus according to claim 6, in which the free edge of the collecting surface is connected to one of the friction discs.

9. Apparatus according to claim 6, in which the collecting surface is connected to a rotary hollow cylinder acting as a support for the collecting surfaces and including means for rotating said cylinder about its own axis independently of the rotation of the friction discs.

* * * * *